United States Patent [19]

Champagne

[11] Patent Number: 5,044,167

[45] Date of Patent: Sep. 3, 1991

[54] VAPOR CYCLE COOLING SYSTEM HAVING A COMPRESSOR ROTOR SUPPORTED WITH HYDRODYNAMIC COMPRESSOR BEARINGS

[75] Inventor: John M. Champagne, Seattle, Wash.

[73] Assignee: Sundstrand Corporation, Rockford, Ill.

[21] Appl. No.: 550,433

[22] Filed: Jul. 10, 1990

[51] Int. Cl.[5] ..... F25B 1/00

[52] U.S. Cl. ..... 62/115; 62/505; 184/6.16; 384/120

[58] Field of Search ..... 62/505, 115; 184/6.16; 417/110, 111, 112; 384/115, 116, 117, 118, 119, 120

[56] References Cited

U.S. PATENT DOCUMENTS

| | | | |
|---|---|---|---|
| 3,221,984 | 12/1965 | Ditzler | 230/207 |
| 4,598,556 | 7/1986 | Mokadam | 62/117 |
| 4,809,521 | 3/1989 | Mokadam | 62/498 |

OTHER PUBLICATIONS

"A New Technology in Energy-Efficient Electrically Driven Aircraft Environmental Control Systems", authored by W. Cloud, J. McNamara and David B. Wigmore, presented at the 21st IECEC Conference, Aug. 25-29, 1986, Article #869390 American Chemical Society, pp. 1696-1702.

*Primary Examiner*—Albert J. Makay
*Assistant Examiner*—John Sollecito
*Attorney, Agent, or Firm*—Antonelli, Terry, Stout & Kraus

[57] ABSTRACT

A refrigeration system (300) having a compressor (12) with a rotor (20) rotatably supported by a plurality of hydrodynamic bearings (22, 24) lubricated by oiless pressurized liquid refrigerant and pressurizing refrigerant which flows to a condenser (34) providing liquid refrigerant which flows to an evaporator (68) in fluid communication with the condenser and the compressor in accordance with the invention includes a first refrigerant circuit (302), coupled to the compressor, for providing pressurized liquid refrigerant to the hydrodynamic bearings from the compressor without flow through a subcooler; and a second refrigerant circuit (304), coupled to the hydrodynamic bearings and to the evaporator including at least one subcooler (42 and 44), for providing a flow of refrigerant from the hydrodynamic bearings through the at least one subcooler to the evaporator, the at least one subcooler cooling the refrigerant flowing between the hydrodynamic bearings and the evaporator.

11 Claims, 3 Drawing Sheets

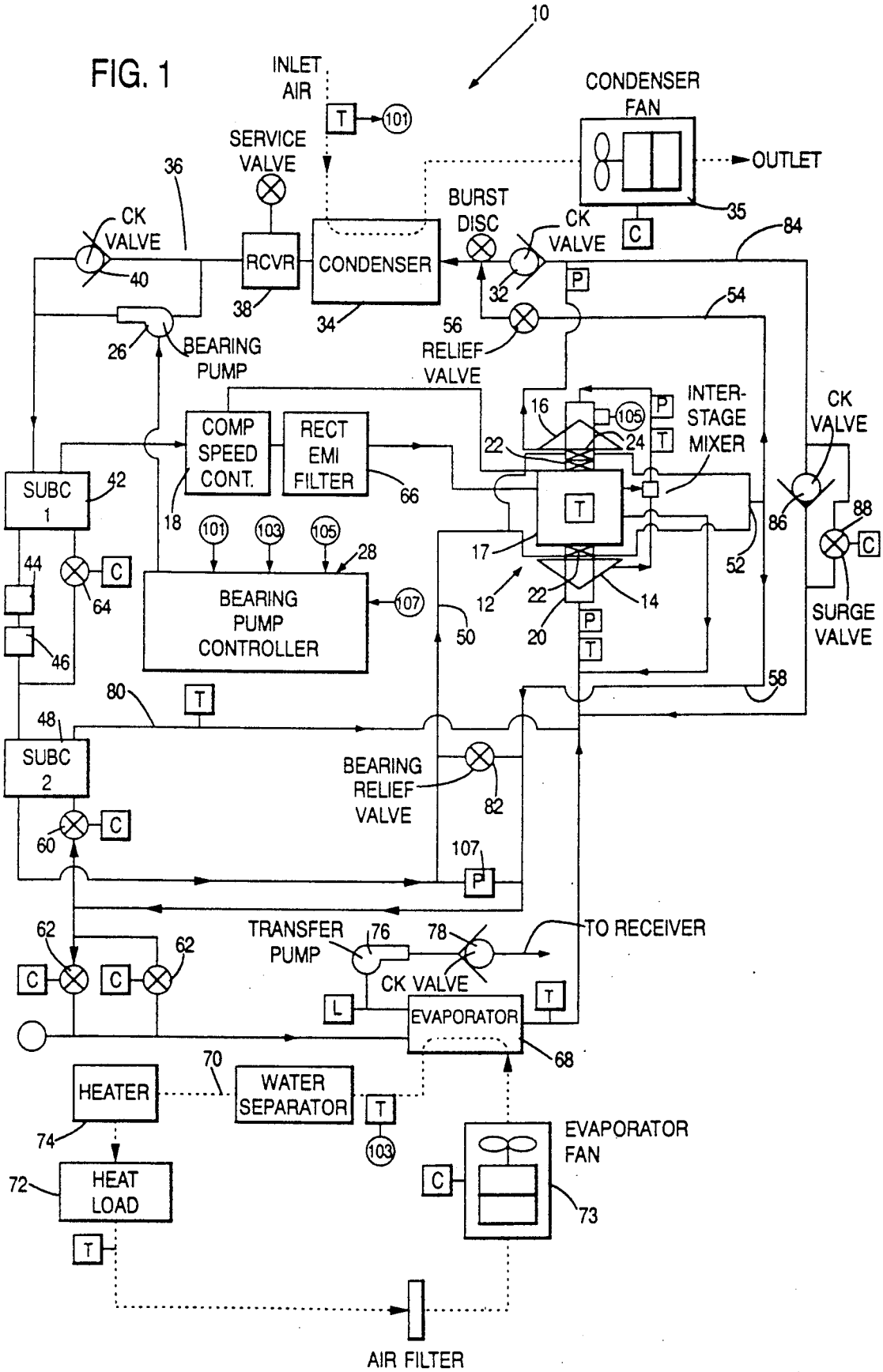
FIG. 1
10
INLET AIR
T
101
CONDENSER FAN
OUTLET
SERVICE VALVE
36
CK VALVE
40
RCVR
38
CONDENSER
34
BURST DISC
CK VALVE
32
C
35
84
P
54
56
RELIEF VALVE
26
BEARING PUMP
COMP SPEED CONT.
RECT EMI FILTER
66
16
105
P
T
INTER-STAGE MIXER
CK VALVE
22
24
SUBC 1
42
18
101
103
105
28
T
17
86
88
C
44
C
64
BEARING PUMP CONTROLLER
107
12
22
14
52
SURGE VALVE
46
50
20
P
T
58
80
T
48
SUBC 2
BEARING RELIEF VALVE
82
60
C
107
P
62
62
TRANSFER PUMP
76
78
TO RECEIVER
C
C
CK VALVE
L
T
EVAPORATOR
68
70
HEATER
WATER SEPARATOR
T
103
74
EVAPORATOR FAN
72
HEAT LOAD
C
73
T
AIR FILTER

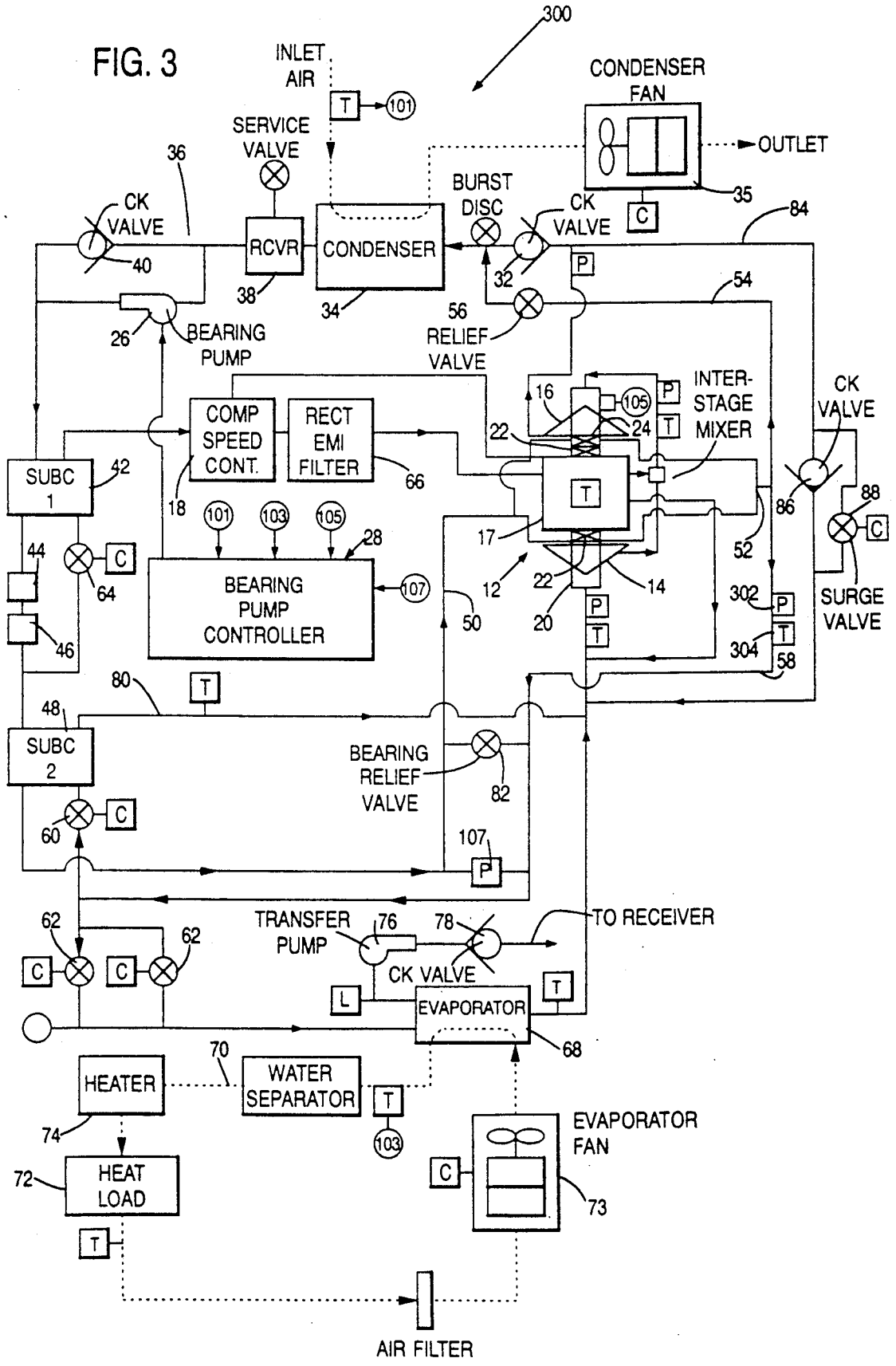
FIG. 3
300
INLET AIR
T
101
CONDENSER FAN
OUTLET
SERVICE VALVE
36
CK VALVE
40
RCVR
38
CONDENSER
34
BURST DISC
CK VALVE
32
C
35
84
P
54
56
RELIEF VALVE
26
BEARING PUMP
COMP SPEED CONT.
RECT EMI FILTER
66
16
105
P
T
INTER-STAGE MIXER
CK VALVE
22
24
SUBC 1
42
18
101
103
105
28
T
86
88
C
44
C
64
BEARING PUMP CONTROLLER
107
17
12
22
14
52
302
P
SURGE VALVE
50
20
P
T
304
T
58
46
80
T
48
SUBC 2
BEARING RELIEF VALVE
82
C
60
107
P
62
TRANSFER PUMP
76
78
TO RECEIVER
62
C
C
CK VALVE
L
EVAPORATOR
T
68
70
HEATER
WATER SEPARATOR
T
103
74
EVAPORATOR FAN
72
HEAT LOAD
C
73
T
AIR FILTER

VAPOR CYCLE COOLING SYSTEM HAVING A COMPRESSOR ROTOR SUPPORTED WITH HYDRODYNAMIC COMPRESSOR BEARINGS

CROSS-REFERENCE TO RELATED APPLICATIONS

Reference is made to Patent Application Ser. No. 550,544, entitled "Bearing Pump Control for Lubricating Hydrodynamic Compressor Bearings" filed on even date herewith, which is assigned to the Assignee of the present invention, which application is incorporated by reference in its entirety; and to Patent Application Ser. No. 550,867, entitled "Superheat Sensor With Single Coupling To Fluid Line", filed on even date herewith, which is assigned to the Assignee of the present invention, which application is incorporated herein by reference in its entirety; and to Patent Application Serial No. 550,506, entitled "Hydrodynamic Bearing Protection System and Method", filed on even date herewith, which is assigned to the Assignee of the present invention, which application is incorporated herein by reference in its entirety; and to Patent Application Ser. No. 550,458, entitled "Speed Control of a Variable Speed Aircraft Vapor Cycle Cooling System Condenser Fan and Compressor and Method of Operation", filed on even date herewith, which is assigned to the Assignee of the present invention, which application is incorporated herein by reference in its entirety; and to Patent Application Ser. No. 550,434, entitled "Control System For Controlling Surge As a Function of Pressure Oscillations and Method", filed on even date herewith, which is assigned to the Assignee of the present invention, which application is incorporated herein by reference in its entirety;

Patent Application Ser. No. 550,432, entitled "Refrigeration System With Oiless Compressor Supported By Hydrodynamic Bearings With Multiple Operation Modes and Method of Operation", filed on even date herewith, which is assigned to the Assignee of the present invention, which application is incorporated herein by reference in its entirety; and to U.S. application Ser. No. 550,631, entitled "Vapor Cycle System Evaporator Control" filed on even date herewith, which is assigned to the Assignee of the present invention, which application is incorporated herein by reference in its entirety.

DESCRIPTION

1. Technical Field

The present invention relates to refrigeration systems which do not include oil within the refrigerant.

2. Background Art

U.S. Pat. No. 4,598,556, which is assigned to the Assignee of the present invention, discloses a high efficiency refrigeration system in which a non-azeotropic binary refrigerant is used. The disclosed system has a multiple stage compressor. Multiple heat exchangers are provided in series with the refrigeration output from the condenser for cooling the refrigerant prior to expansion by the evaporator.

U.S. Pat. No. 4,809,521, which is assigned to the Assignee of the present invention, discloses a high efficiency cooling system utilizing non-azeotropic binary refrigerant fluid having a single stage compressor. A plurality of heat exchangers are coupled between the output of the condenser and the evaporator for cooling the refrigerant prior to expansion by the evaporator.

An article entitled "A New Technology in Energy-Efficient Electrically Driven Aircraft Environmental Control Systems", authored by W. Cloud, J. McNamara and David B. Wigmore, ACS Paper No. 869390, presented at the 21st IECEC Conference, Aug. 25-29, 1986, discloses a vapor cycle cooling system for airframes having a multiple stage compressor with multiple subcoolers for controlling the temperature of a non-azeotropic: binary refrigerant. The disclosed system does not suggest that the refrigerant may be used to lubricate hydrodynamic bearings supporting the compressor rotor.

U.S. Pat. No. 3,221,984 discloses an oil supply system for a compressor in a refrigeration system. The oil supply system provides pressurized oil to the bearings of the compressor after the compressor motor is deenergized while the compressor is still rotating at high speed. The rotational inertia of the compressor applies pressurized gas from the compressor to an oil tank above the oil level which forces oil to flow to the bearings of the compressor for a period sufficient for the compressor to stop rotating.

Compressors are known which utilize oiless refrigerant to lubricate bearings. See U.S. Pat. Nos. 3,728,875 and 4,020,642. U.S. Pat. No. 4,020,642 discloses a bearing pump integral with the compressor shaft which pressurizes liquid refrigerant flowing from the condenser prior to application to the bearings. The bearing pump is powered by rotation of the compressor and therefore cannot be separately activated.

DISCLOSURE OF INVENTION

The present invention is a refrigeration system and method of operating a refrigeration system in which energy consumption is reduced by supplying an oiless refrigerant directly to hydrodynamic bearings which rotatably support a compressor rotor without subcooling. The temperature of the refrigerant rotatably supporting a rotor of the compressor is raised to reduce viscosity and lower drag. Increasing the temperature of the liquid refrigerant flowing to the hydrodynamic bearings eliminates heat conduction between the hot gas output of the compressor and the cold liquid refrigerant input to the bearings. The system provides dissipation of the heat absorbed by the refrigerant flowing through the hydrodynamic bearings by a subcooler. The temperature of the liquid refrigerant entering the evaporator may be effectively controlled with a subcooler to prevent the bearing losses from causing the evaporator to operate at undesirable elevated temperatures while reducing energy consumption.

Control of the velocity of the rotor of the compressor, as disclosed in the above-referenced Patent application Ser. No. 550,506, entitled "Hydrodynamic Bearing Protection System and Method", may be utilized to prevent the refrigerant flowing through the hydrodynamic bearings from changing state from liquid to vapor which could lead to serious damage or failure of the journals of the compressor rotor.

FIG. 1 illustrates a refrigeration system 10 which has been developed by the Assignee of the present invention that is disclosed in the cross-referenced patent applications. A preferred application of the refrigeration system 10 is cooling avionics contained in an airframe. The refrigeration system employs a non-azeotropic binary refrigeration fluid. A centrifugal compressor 12, comprised of two compressor stages 14 and 16 is driven by a high-speed electrical motor 17 which runs at a rotational velocity of up to 70,000 rpm. The motor 17 is driven by a speed control 18 of the type described in U.S. patent application Ser. Nos. 319,719, 319,727, and 320,224 which are assigned to the Assignee of the present invention. The rotor 20 on which the compressor stages 14 and 16 are mounted is supported by a pair of hydrodynamic radial bearings 22 and a hydrodynamic thrust bearing 24. A hydrodynamic bearing, which is well known, separates surfaces moving relative to each other with a lubricant which is pressurized from a pressure source. The structure of the hydrodynamic radial and thrust bearings 22 and 24 is not illustrated for the reason that it is conventional and does not form part of the present invention.

The hydrodynamic radial and thrust bearings 22 and 24 are maintained by pressurized oiless liquid state refrigerant which is provided from two sources. The first source is from the second stage 16 of the compressor 12 and the second source is from a bearing pump 26 which is activated by a bearing pump controller 28 in accordance with predetermined conditions of operation of the refrigeration system which are based upon sensed operation parameters as described below. The function of the bearing pump 26 is to make up for a deficiency in the pressure and quantity of refrigerant outputted from the second stage 16 of the compressor 12 which is necessary to maintain the hydrodynamic radial and thrust bearings 22 and 24 during predetermined operational conditions of the refrigeration system 10. The bearing pump 26 outputs pressurized refrigerant at a pressure higher than the output pressure of the second stage 16 of the compressor 12 when the bearing pump is activated by the bearing pump controller 28 as described below.

The flow of refrigerant through the refrigeration system 10 is described as follows. Pressure and temperature transducers, which are located at various points in the system, are identified by a square box respectively containing the letters "P" and "T". Control signals applied to controllable expansion valves, which are provided from a system controller (not illustrated), are identified by a square box labelled with the letter "C". A square box containing the letter "L" is a liquid level sensor providing a signal to the aforementioned system controller (not illustrated). The connections of the liquid level sensor and pressure and temperature transducers to the system controller (not illustrated) have been omitted. Pressurized refrigerant flows from the second stage 16 of the compressor 12 through check valve 32 to condenser 34 at which the pressurized refrigerant gas is condensed to liquid. A first heat exchange fluid, which in this application is air, flows in a counterflow direction through the condenser 34 under suction created by a condenser fan 35 to remove heat from the refrigerant and cause the refrigerant to condense to liquid. The refrigerant is outputted by the condenser 34 to a refrigerant circuit 36 which couples the condenser to the radial and thrust hydrodynamic bearings 22 and 24 through flow path including receiver 38, check valve 40, a first subcooler 42, filter drier 44, sight glass 46, a second subcooler 48 and from the output of the second subcooler 48 through line 50 to the input of the radial and thrust hydrodynamic bearings 22 and 24. The liquid refrigerant discharged from the radial and hydrodynamic bearings 22 and 24 is combined at point 52. The liquid refrigerant flows from point 52 in a first path 54 when relief valve 56 is open to the input of the condenser 34 and through a second path 58 back to an expansion valve 60 and to a pair of parallel connected expansion valves 62. The relief valve 56 is opened when the valves 60 and 62 are closed.

The subcooler 42 functions to cool liquid refrigerant outputted by the receiver 38 to a temperature determined by expansion valve 64 which controls the superheat at the inlet of the second stage 16 of the compressor 12. The expanded refrigerant outputted by the expansion valve 64 cools the liquid refrigerant flowing into the subcooler 42. The two phase refrigerant flowing from the subcooler 42 cools the electronics contained in the compressor speed control 18 and the electronics contained in the rectifier and EMI filter 66 which are components used for driving the electrical motor 17.

The expansion valves 60 and 62 perform different functions. The expansion valve 60 controls the superheat at the output of the subcooler 48. The expansion valves 62 may perform one of two functions. The first function is the controlling of the superheat out of the evaporator 68 which cools air flowing in a direction counter to the flow of refrigerant through the evaporator in an airflow path 70 which cools an avionics heat load 72. The second function is the control of the air temperature out of the evaporator. Only one function may be performed at a time. Fan 73 provides the pressure head to cause air to circulate in the airflow path 70. Optionally, a heater 74, which may have multiple stages, may be provided in the air path 70 when cooling of the heat load 72 which may be avionics is not necessary. The evaporator 68 is coupled to the receiver through a transfer pump 76 and a check valve 78.

A function of the second subcooler 48 is to lower the temperature of liquid refrigerant flowing out of the first subcooler 42 to a temperature at which the refrigerant will maintain a liquid state flowing through the hydrodynamic radial and thrust bearings 22 and 24 after absorbing heat therein. The output 80 from the second subcooler 48 combines with the refrigerant flow to the first stage 14 of the compressor 12. The output from the evaporator 68 also supplies the input to the first stage 14 of the compressor.

A bearing relief valve 82 bypasses the hydrodynamic radial and thrust bearings 22 and 24 when the pressure across the bearings reaches a predetermined maximum pressure, such as 50 psi, to avoid dropping excessive pressure across the hydrodynamic radial and thrust bearings and which may damage the bearings. A $\Delta P$ pressure transducer 107 senses when the pressure drop across the radial and thrust bearings 22 and 24 is less than 18 psi. The function of $\Delta P$ pressure transducer 107 is described below in conjunction with FIG. 2.

The output from the second stage 16 of the compressor 12 also flows through a fluid circuit 84 which contains a parallel connection of a check valve 86 and a surge valve 88. These valves permit recirculation of refrigerant from the output stage 16 back to the input stage 14 of the compressor 12 during surge conditions in a manner which is known.

As stated above, the function of the bearing pump 26 is to provide supplemental pressurized refrigerant to the hydrodynamic radial and thrust bearings 22 and 24 under conditions of operation of the compressor 12 where the output pressure from the second stage 16 is insufficient to maintain the necessary minimum pressure and flow rate to the hydrodynamic radial and thrust bearings. The bearing pump controller 28 activates the bearing pump 26 in accordance with predetermined conditions or operation of the refrigeration system 10 as discussed below in conjunction with FIG. 2. The predetermined conditions are controlled by sensing a plurality of operational parameters of the refrigeration system as discussed below with respect to FIG. 2.

FIG. 2 illustrates a block diagram of a bearing pump controller 28 as illustrated in FIG. 1. The bearing pump controller 28 is responsive to at least one sensor and in a preferred implementation, as illustrated in FIG. 2, is responsive to sensor inputs illustrated in FIG. 1 from a first temperature sensor 101 which senses the temperature of inlet air to the condenser 34, a second temperature sensor 103 which senses the output temperature of air in path 70 from the evaporator 68, speed sensor 105 which senses the rotational speed of the rotor 20 of the compressor 12, and ΔP pressure transducer 107 which senses the pressure drop across the hydrodynamic radial and thrust bearings 22 and 24. The bearing pump 26 is turned on when the output state from latch 100, which may be a conventional flip-flop, is high. The output state of the latch 100 is reset to a low level which causes the bearing pump 26 to turn off when the output from AND gate 102 goes high. The output from AND gate 102 goes high when four predetermined conditions exist concurrently. The first predetermined condition is when the output of comparator 104 goes high which occurs when the temperature sensed by sensor 101 is greater than 95° F. The second predetermined condition is when the output of comparator 106 goes high when the difference between the temperature sensed by the sensor 101 and the sensor 103 is greater than 45°. The third predetermined condition occurs when the output of comparator 108 goes high which occurs when the rotational velocity of the rotor 20 sensed by sensor 105 is greater than 55,000 rpm. The fourth predetermined condition occurs after the overall system has been turned on for a predetermined time interval by activating of the compressor motor 17 under the control of the compressor speed control 18. A fifth predetermined condition which causes the bearing pump to turn on is when the comparator output 110 goes high when the drop sensed by the ΔP pressure transducer 107 is less than 18 psi causing the output of AND gate 112 to go high after a debounce delay period of one second due to the one second delay 114 delaying the comparator 110 output for one second if the output of the comparator is high for at least one second. The output of AND gate 112 is applied to a first input of OR gate 116 which has a second input which is an inversion of the output of AND gate 102. The output of the OR gate sets the latch 100 causing the bearing pump 26 to be activated when anyone of the aforementioned five predetermined conditions occurs. When the output of the AND gate 112 is low, the latch 100 is set as a consequence of the second input to the OR gate 116 being an inversion of the output of the AND gate 102. As a result, if any one of the outputs from the comparators 104–110 is low or the compressor motor has not been on for more than two minutes, the output of the latch 100 will be high which causes the bearing pump 26 to apply an increased flow rate of higher pressure refrigerant to the refrigerant circuit 36. The pressured refrigerant provided by the bearing pump 26 may be expanded to cool the evaporator 68.

A method of operating the refrigeration system of FIGS. 1 and 2 comprises applying pressurized refrigerant to the hydrodynamic radial and thrust bearings 22 and 24 flowing from the compressor 34 during operation of the refrigeration system 10 and providing supplemental pressurized refrigerant from the bearing pump 26 to the hydrodynamic bearings at a pressure higher than a pressure of refrigerant provided by the compressor 12 in accordance with predetermined conditions of operation of the refrigeration system. One of the predetermined conditions is a temperature of the air flowing through the condenser 34 sensed by a first temperature sensor 101 which is coupled to the controller 28 is less than a set temperature which, as illustrated in FIG. 2, is 95° F. Another of the predetermined conditions is a temperature difference between the air flowing through the condenser 34 and the air flowing through the evaporator 68 sensed respectively by the first and second temperature sensors 101 and 103 is less than a set temperature which is illustrated in FIG. 2 as 45° F. Another of the predetermined conditions is that the refrigeration system 10 has been turned on for less than two minutes. Another of the predetermined conditions is that a pressure drop across the hydrodynamic bearings 22 and 24 sensed by the ΔP pressure transducer 107 coupled to the bearing pump controller 28 is less than a set pressure difference which is illustrated in FIG. 2 as 18 psi. Finally, one of the predetermined conditions is a rotational speed of the turbine rotor 20 sensed by speed sensor 105 coupled to the bearing pump controller 28 sensing a speed of rotation of the rotor 20 is less than a set speed which in FIG. 2 is illustrated as 55,000 rpm.

In the system of FIGS. 1 and 2 utilizing a non-azeotropic refrigerant mixture to lubricate the bearings 22 and 24, tests have revealed that bearing losses have exceeded the projected losses. This loss is the result of the liquid refrigerant, which has been cooled by the second subcooler 48, having a higher viscosity resultant from the cooling. The increased viscosity produces a higher power draw for a given set of conditions. Additionally, an additional source of heat load on the liquid refrigerant could be from the second stage 16 of the compressor 12 to the liquid refrigerant flowing through the bearings. The thrust bearing 24 is located closest to the second stage along with one of the radial bearings 22. This heat path is enhanced by an increased temperature differential between the hot gas output from the second stage of the compressor and the cold liquid refrigerant flowing into the bearings. In a refrigeration system having a non-azeotropic binary refrigerant inlet quality for an evaporator is tied to the heat exchanger performance. Actual bearing losses have a performance impact on the vapor cycle cooling system operation. The temperature of the refrigerant at the inlet to the evaporator 68 has a direct effect on the required boiling pressure necessary to achieve a desired temperature at the outlet of the evaporator 68.

The higher bearing losses cause the temperature of the refrigerant at the outlet of the subcooler 48 to be increased resulting in a higher temperature at the inlet of the evaporator 68. As a result, a higher evaporator refrigerant flow rate is required to achieve a desired rate of cooling for the heat load 72 because of the reduced enthalpy change available. The higher boiling pressure causes a higher condensing pressure resulting in increased power consumption for the operation of the system and higher than predicted temperature at the heat load 72.

The present invention modifies the refrigerant flow disclosed in the aforementioned patent applications by providing for refrigerant to flow directly from the condenser through the bearing pump to the hydrodynamic bearings which causes the heat load of the hydrodynamic bearings to be picked up by the refrigerant which rotatably supports the rotor of the compressor prior to flow through a subcooler. Energy consumption is lessened by providing higher temperature refrigerant from the condenser directly to the hydrodynamic bearings which has a lower viscosity than refrigerant supplied from a subcooler resulting in less friction that lowers energy consumption. The first subcooler has an increased cooling capacity in comparison with the first subcooler disclosed in the aforementioned patent application to permit the higher heat load carried by the refrigerant flowing through the bearings to be rejected by the first subcooler. The pressure drop across the first subcoolers expansion valve may be increased so that the boiling pressure of the refrigerant is reduced. The second stage of the compressor rotor is enlarged to handle the extra flow necessary to provide the flow from the condenser to the first subcooler.

A refrigeration system having a compressor rotor rotatably supported by a plurality of hydrodynamic bearings lubricated by oiless pressurized liquid refrigerant and pressurizing refrigerant which flows to a condenser providing liquid refrigerant which flows to an evaporator in fluid communication with the condenser and the compressor in accordance with the invention includes a first refrigerant circuit coupled to the compressor for providing pressurized liquid refrigerant to the hydrodynamic bearings from the compressor without flow through a subcooler; and a second refrigerant circuit coupled to the hydrodynamic bearings and to the evaporator including at least one subcooler for providing a flow of refrigerant from the hydrodynamic bearings through the at least one subcooler to the evaporator, the at least one subcooler cooling the refrigerant flowing between the hydrodynamic bearings and the evaporator. The second refrigerant circuit includes a first and a second subcooler with the first subcooler cooling refrigerant flowing from the hydrodynamic bearings and the second subcooler cooling refrigerant flowing to the evaporator. The invention further includes a first expansion valve coupled to an outlet of the first subcooler for expanding refrigerant flowing from the first subcooler which provides expanded refrigerant to the first subcooler to cool the refrigerant flowing through the first subcooler; and a second expansion valve coupled to an outlet of the second subcooler for expanding refrigerant flowing from the second subcooler which provides expanded refrigerant to the second subcooler to cool the refrigerant flowing through the second subcooler. A bearing pump is coupled to the first refrigerant circuit for increasing the pressure of the liquid refrigerant provided from the condenser to the hydrodynamic bearings.

A method of operating a refrigeration system having a compressor with a rotor rotatably supported by a plurality of hydrodynamic bearings lubricated by oiless pressurized liquid refrigerant and pressurizing refrigerant which flows to a condenser providing liquid refrigerant which flows to an evaporator in fluid communication with the condenser and the compressor in accordance with the invention includes providing pressurized liquid refrigerant flow to the hydrodynamic bearings from the compressor without flow through a subcooler; and providing liquid refrigerant flow from the hydrodynamic bearings through at least one subcooler which cools the refrigerant flowing from the hydrodynamic bearings to the evaporator. The refrigerant flow from the hydrodynamic bearings flows through a first subcooler and a second subcooler. A first expansion valve coupled to an outlet of the first subcooler expands refrigerant flowing from the first subcooler which provides expanded refrigerant to the first subcooler to cool the refrigerant flowing through the first subcooler; and a second expansion valve coupled to an outlet of the first subcooler expands refrigerant flowing from the second subcooler which provides expanded refrigerant to the second subcooler to cool the refrigerant flowing to the evaporator. The refrigerant flows from a bearing pump, coupled to the compressor, to the hydrodynamic bearings. The refrigerant flows from the first subcooler to the compressor; and the refrigerant flows from the second subcooler to the compressor and the refrigerant flowing from the first expansion valve flows through electronics used for controlling the refrigeration system to cool the electronics.

BRIEF DESCRIPTION OF THE DRAWINGS

FIG. 1 illustrates a refrigeration system developed by the Assignee of the present invention.

FIG. 3 illustrates a refrigeration system in accordance with the present invention.

BEST MODE FOR CARRYING OUT THE INVENTION

Figure 2:
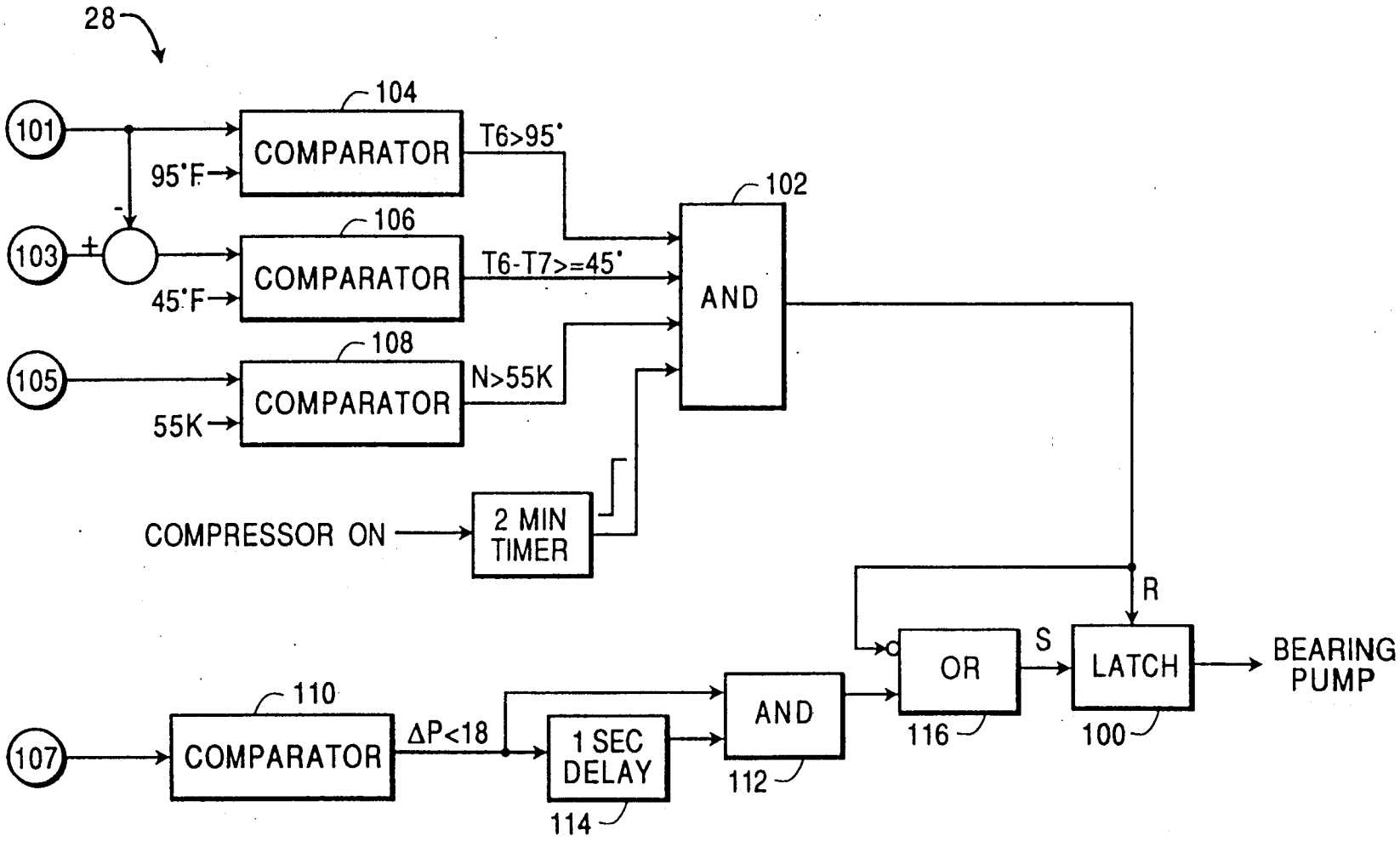
FIG. 2 illustrates a controller for a bearing pump of the system of FIG. 1.

FIG. 3 illustrates a refrigeration system 300 in accordance with the present invention. Like reference numerals identify like parts in FIGS. 1-3. It should be understood that the control for the operation of the system 300 is generally in accordance with the prior art of FIGS. 1 and 2 except that the bearing pump 26 is operated continuously under control of the system control 27 while the compressor 12 is operating to boost the pressure of the liquid refrigerant outputted from the condenser 34. The bearing pump 26 may be activated before or at the time of turning on the compressor motor 17. The bearing pump controller 28 of FIG. 1 has been eliminated. The bearing pump 26 in FIG. 1 supplies a "safety margin" or operating point where the bearing inlet temperature is lower than the refrigerant "bubble temperature" so that the combined effects of pressure loss and heat gain to the refrigerant does not result in flashing of the refrigerant. The subcoolers 42 and 48 in the system of FIG. 1 performed this function. The refrigeration system 300 differs from the system 10 of FIG. 1 in that the flow of refrigerant is modified between the receiver 38 and the hydrodynamic bearings 22 and 24 and between the hydrodynamic bearings and the first subcooler 42. A parallel refrigerant circuit including a check valve of the system of FIG. 1 has been eliminated. The relative size of the first and second stages 14 and 16 is changed to provide for increased flow from the second stage when compared to the system of FIG. 1 to account for the additional flow of refrigerant from the hydrodynamic bearings 22 and 24 to the interstage point between the first and second stages of the compressor. The cooling capacity of the first subcooler 42 may be increased to reject the additional heat load absorbed from the hydrodynamic bearings 22 and 24. The pressure drop across the first subcooler 42 expansion valve is increased so that the boiling pressure is reduced. A first refrigerant circuit 302 is coupled to the compressor 34 through the receiver 38 for providing pressurized liquid refrigerant to the hydrodynamic bearings 22 and 24 from the compressor without flow through a subcooler. A second refrigerant circuit 304 is coupled to the hydrodynamic bearings 22 and 24 and to the evaporator 68. The second refrigeration circuit 304 includes at least one subcooler and preferably contains at least the two subcoolers 42 and 48. The second refrigerant circuit 304 provides a flow of refrigerant from the hydrodynamic bearings 22 and 24 through the at least one subcooler to the evaporator 68. The at least one subcooler cools the refrigerant flowing between the hydrodynamic bearings and the evaporator. As illustrated, the first subcooler 42 cools the flow of refrigerant flowing from the hydrodynamic bearings 22 and 24 and the second subcooler cools the refrigerant flowing to the evaporator 68. The first expansion valve 64 is coupled to an outlet of the first subcooler for expanding refrigerant flowing from the first subcooler which provides expanded refrigerant to the first subcooler to cool the refrigerant flowing through the first subcooler. The second expansion valve 60 is coupled to an outlet of the second subcooler 48 for expanding refrigerant flowing from the second subcooler which provides expanded refrigerant to the second subcooler to cool the refrigerant flowing through the second subcooler. The refrigerant flows from the first subcooler through electronics used for controlling the refrigeration system to cool the electronics. As illustrated, the speed controller 18 and rectifier and EMI filter 66 are cooled by the flow of refrigerant from the first subcooler 42 to radial and hydrodynamic bearings 22 and 24. The flow of expanded refrigerant from the second subcooler 48 is to the inlet of the two-stage compressor 12 as illustrated in FIG. 1.

As a consequence of the foregoing modifications of the system of FIG. 1, increased performance is obtained from the second subcooler 48 and the evaporator 68 due to the lowering of the temperature of the liquid refrigerant flowing to the evaporator 68. More efficient rejection of hydrodynamic bearing heat load occurs at the first subcooler. Finally, power consumption of the system is reduced as a consequence of the viscosity of the refrigerant entering the hydrodynamic bearings 22 and 24 being reduced which reduces friction as a result of the higher temperature of the refrigerant at the hydrodynamic bearings when compared to the system of FIG. 1. The outer diameter of the flow path 302 between the receiver 38 and the bearing pump 26 may be increased with respect to the prior art to eliminate cavitation while satisfying flow requirements of the hydrodynamic bearings 22 and 24 as a consequence of extra subcooling gained from the higher head produced by the bearing pump 26.

A method of operating the refrigeration system 300 comprises providing pressurized liquid refrigerant flow to the hydrodynamic bearings 22 and 24 through the first refrigeration circuit from the compressor 12 without flow through a subcooler; and providing liquid refrigerant flow through the second refrigerant circuit from the hydrodynamic bearings through at least one subcooler which preferably is at least two subcoolers 42 and 48 which cool the refrigerant flowing from the hydrodynamic bearings to the evaporator. The refrigerant flow from the hydrodynamic bearings 22 and 24 flows through the first subcooler 42 and the second subcooler 48. The first expansion valve 64 coupled to an outlet of the first subcooler expands refrigerant flowing from the first subcooler 42 which provides expanded refrigerant to the first subcooler to cool the refrigerant flowing through the first subcooler; and the second expansion valve 60 coupled to the outlet of the second subcooler expands refrigerant flowing from the second subcooler which provides expanded refrigerant to the second subcooler to cool the refrigerant flowing to the evaporator 68.

While the invention has been described in terms of its preferred embodiment, it should be understood that numerous modifications may be made thereto without departing from the spirit and scope of the invention as defined in the appended claims. It is intended that all such modifications fall within the scope of the appended claims.

I claim:

1. A refrigeration system having a compressor with a rotor rotatably supported by a plurality of hydrodynamic bearings lubricated by oiless pressurized liquid refrigerant and pressurizing refrigerant which flows to a condenser providing liquid refrigerant which flows to an evaporator in fluid communication with the condenser and the compressor comprising:

a first refrigerant circuit, coupled to the compressor, for providing pressurized liquid refrigerant to the hydrodynamic bearings from the compressor without flow through a subcooler; and a second refrigerant circuit, coupled to the hydrodynamic bearings and to the evaporator including at least one subcooler, for providing a flow of refrigerant from the hydrodynamic bearings through the at least one subcooler to the evaporator, the at least one subcooler cooling the refrigerant flowing between the hydrodynamic bearings and the evaporator.

2. A refrigeration system in accordance with claim 1 wherein:

the second refrigerant circuit includes a first and a second subcooler with the first subcooler cooling refrigerant flowing from the hydrodynamic bearings and the second subcooler cooling refrigerant flowing to the evaporator.

3. A refrigeration system in accordance with claim 2 further comprising:

a first expansion valve, coupled to an outlet of the first subcooler, for expanding refrigerant flowing from the first subcooler which provides expanded refrigerant to the first subcooler to cool the refrigerant flowing through the first subcooler; and a second expansion valve, coupled to an outlet of the second subcooler, for expanding refrigerant flowing from the second subcooler which provides expanded refrigerant to the second subcooler to cool the refrigerant flowing through the second subcooler.

4. A refrigeration system in accordance with claim 3 further comprising:

a bearing pump, coupled to the first refrigerant circuit and to the condenser, for providing pressurized refrigerant at a pressure higher than a pressure of the refrigerant provided by the compressor; and wherein the refrigerant flows from the first subcooler to the compressor; and the refrigerant flows from the second subcooler to the compressor.

5. A refrigeration system in accordance with claim 4 wherein:

the refrigerant flowing from the first expansion valve flows through electronics used for controlling the refrigeration system to cool the electronics.

6. A method of operating a refrigeration system having a compressor with a rotor rotatably supported by a plurality of hydrodynamic bearings lubricated by oiless pressurized liquid refrigerant and pressurizing refrigerant which flows to a condenser providing liquid refrigerant which flows to an evaporator in fluid communication with the condenser and the compressor comprising:

providing pressurized liquid refrigerant flow to the hydrodynamic bearings from the compressor without flow through a subcooler; and providing liquid refrigerant flow from the hydrodynamic bearings, through at least one subcooler, which cools the refrigerant flowing from the hydrodynamic bearings to the evaporator.

7. A method in accordance with claim 6 wherein:

the refrigerant flow from the hydrodynamic bearings flows through a first subcooler and a second subcooler.

8. A method in accordance with claim 7 wherein:

a first expansion valve, coupled to an outlet of the first subcooler, expands refrigerant flowing from the first subcooler which provides expanded refrigerant to the first subcooler to cool the refrigerant flowing through the first subcooler; and a second expansion valve, coupled to an outlet of the second subcooler, expands refrigerant flowing from the second subcooler which provides expanded refrigerant to the second subcooler to cool the refrigerant flowing to the evaporator.

9. A method in accordance with claim 8 wherein:

refrigerant flows from a bearing pump, coupled to the compressor to the hydrodynamic bearings.

10. A method in accordance with claim 9 wherein:

the refrigerant flows from the first subcooler to the compressor; and the refrigerant flows from the second subcooler to the compressor.

11. A method in accordance with claim 10 wherein:

the refrigerant flowing from the first expansion valve flows through electronics used for controlling the refrigeration system to cool the electronics.

* * * * *